US011267034B2

(12) United States Patent
Ishizuka et al.

(10) Patent No.: US 11,267,034 B2
(45) Date of Patent: Mar. 8, 2022

(54) FORMING DEVICE AND FORMING METHOD

(71) Applicant: SUMITOMO HEAVY INDUSTRIES, LTD., Tokyo (JP)

(72) Inventors: Masayuki Ishizuka, Ehime (JP); Kimihiro Nogiwa, Ehime (JP); Norieda Ueno, Tokyo (JP); Masayuki Saika, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 100 days.

(21) Appl. No.: 16/115,034

(22) Filed: Aug. 28, 2018

(65) Prior Publication Data

US 2018/0361458 A1 Dec. 20, 2018

Related U.S. Application Data

(63) Continuation of application No. PCT/JP2017/004546, filed on Feb. 8, 2017.

(30) Foreign Application Priority Data

Mar. 1, 2016 (JP) ..... JP2016-038796

(51) Int. Cl.
*B21D 26/00* (2006.01)
*B21D 26/041* (2011.01)
(Continued)

(52) U.S. Cl.
CPC ..... *B21D 26/041* (2013.01); *B21D 19/08* (2013.01); *B21D 22/025* (2013.01);
(Continued)

(58) Field of Classification Search
CPC .. B21D 26/033; B21D 26/035; B21D 26/041; B21D 26/043; B21D 26/047; B21D 26/045
See application file for complete search history.

(56) References Cited

U.S. PATENT DOCUMENTS 6,067,831 A * 5/2000 Amborn ..... B21D 26/033 29/421.1
8,899,085 B2 12/2014 Adams et al.
(Continued)

FOREIGN PATENT DOCUMENTS

CN 104525676 A 4/2015
EP 2 172 285 A1 4/2010
(Continued)

OTHER PUBLICATIONS

International Search Report issued in Application No. PCT/JP2017/004546, dated Mar. 7, 2017.
(Continued)

*Primary Examiner* — Debra M Sullivan
(74) *Attorney, Agent, or Firm* — Michael Best & Friedrich LLP

(57) ABSTRACT

The controller controls the gas supply of the gas supply unit so as to maintain a pressure in a metal pipe material at a first pressure when a gas is supplied into the metal pipe material which is formed into a pipe portion in a main cavity portion in a state where an upper die and a lower die are joined to each other. It is possible to prevent pressure drop in the pipe portion caused by cooling of the pipe portion due to a contact between the dies, and the pipe portion. Thus, it is possible to suppress a decrease in a force for pressing the pipe portion against the dies. It is possible to suppress a decrease in adhesion between the pipe portion and the dies
(Continued)

when the metal pipe is formed, and it is possible to suppress occurrence of variations in hardenability in the pipe portion.

18 Claims, 11 Drawing Sheets

(51) Int. Cl.

| | |
|---|---|
| ***B21D 37/16*** | (2006.01) |
| ***B21D 19/08*** | (2006.01) |
| ***B21D 22/02*** | (2006.01) |
| ***B21D 26/037*** | (2011.01) |
| ***B21D 26/043*** | (2011.01) |
| ***B21D 26/047*** | (2011.01) |
| *B21D 26/039* | (2011.01) |
| *B21D 26/045* | (2011.01) |

(52) U.S. Cl.
CPC ..... *B21D 26/037* (2013.01); *B21D 26/043* (2013.01); *B21D 26/047* (2013.01); *B21D 37/16* (2013.01); *B21D 26/039* (2013.01); *B21D 26/045* (2013.01)

(56) References Cited

U.S. PATENT DOCUMENTS

| | | | | |
|---|---|---|---|---|
| 9,321,093 | B2 | 4/2016 | Adams et al. | |
| 2004/0040636 | A1* | 3/2004 | Watanabe ..... | B21D 37/16 148/570 |
| 2010/0186473 | A1* | 7/2010 | Mizumura ..... | B21D 26/043 72/60 |
| 2013/0167607 | A1 | 7/2013 | Adams et al. | |
| 2016/0228935 | A1 | 8/2016 | Adams et al. | |
| 2016/0279693 | A1 | 9/2016 | Ueno et al. | |

FOREIGN PATENT DOCUMENTS

| | | | |
|---|---|---|---|
| EP | 3 231 526 | A1 | 10/2017 |
| JP | 2001-259754 | A | 9/2001 |
| JP | 2002-126827 | A | 5/2002 |
| JP | 2012-000654 | A | 1/2012 |
| JP | 2013-103253 | A | 5/2013 |
| JP | 2015-505275 | A | 2/2015 |
| JP | 2015-112608 | A | 6/2015 |
| WO | WO-01/23116 | A1 | 4/2001 |
| WO | WO-2013/102217 | A1 | 7/2013 |

OTHER PUBLICATIONS

Search report issued in European Application No. 17759581.6, dated Mar. 14, 2019.
Article 94(3) Communication issued in European Application No. 17759581.6, dated Mar. 26, 2019.
Office Action issued in Chinese Application No. 201780014553.4, dated Sep. 27, 2019.

* cited by examiner

FORMING DEVICE AND FORMING METHOD

RELATED APPLICATIONS

Priority is claimed to Japanese Patent Application No. 2016-038796, filed Mar. 1, 2016, and International Patent Application No. PCT/JP2017/004546, the entire content of each of which is incorporated herein by reference.

BACKGROUND

Technical Field

Certain embodiments of the present invention relate to a forming device and a forming method.

Description of Related Art

In related art, a forming device is known in which a gas is supplied into a heated metal pipe material so as to expand the metal pipe material and a metal pipe having a pipe portion and a flange portion is formed. For example, a forming device described in the related art includes an upper die and a lower die which are paired with each other, a gas supply unit which supplies a gas into a metal pipe material held between the upper die and the lower die, a first cavity portion (main cavity) which is formed by joining between the upper die and the lower die and forms a pipe portion, and a second cavity portion (sub cavity) which communicates with the first cavity portion and forms a flange portion. In the forming device, the dies are closed and the gas is supplied into the heated metal pipe material so as to expand the metal pipe material, and thus, the pipe portion and the flange portion can be simultaneously formed.

SUMMARY

According to an embodiment of the present invention, there is provided a forming device for forming a metal pipe having a pipe portion, including: a first die and a second die which are paired with each other and constitute a first cavity portion for forming the pipe portion; a drive mechanism configured to move at least one of the first die and the second die in a direction in which the dies are to be joined to each other; a gas supply unit configured to supply a gas into a metal pipe material which is held between the first die and the second die and is heated; and a controller configured to control driving of the drive mechanism and gas supply of the gas supply unit, in which the controller controls the gas supply of the gas supply unit so as to maintain a pressure in the metal pipe material at a first pressure when the gas is supplied from the gas supply unit into the metal pipe material and the metal pipe material is formed into the pipe portion in the first cavity portion in a state where the first die and the second die are joined to each other.

According to another embodiment of the present invention, there is provided a forming method for forming a metal pipe having a pipe portion, the method including: preparing a heated metal pipe material between a first die and a second die; forming a first cavity portion for forming the pipe portion between the first die and the second die by moving at least one of the first die and the second die in a direction in which the dies are to be joined to each other; and forming the pipe portion in the first cavity portion by supplying gas so as to maintain a pressure in the metal pipe material at a first pressure.

DETAILED DESCRIPTION

Figure 1:
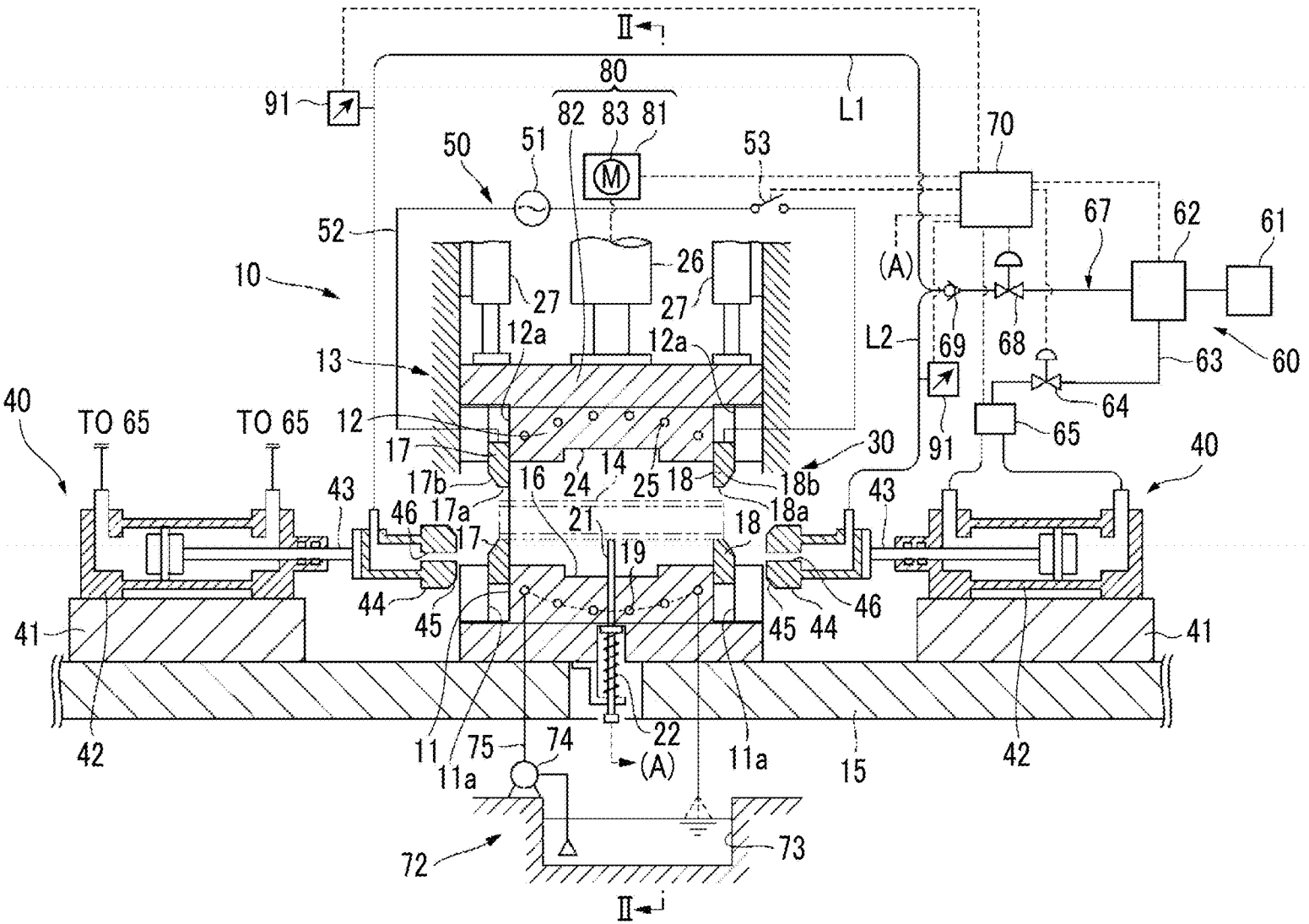
FIG. 1 is a schematic configuration view of a forming device.

In the forming device of the related art, the expanded metal pipe material comes into contact with portions of the upper die and the lower die constituting the first cavity portion, and thus, hardening of the metal pipe is performed. When this hardening is performed, adhesion between the metal pipe, and the upper die and the lower die may decrease, and thus, there is a problem that variations in hardenability of the metal pipe occur.

It is desirable to provide a forming device and a forming method capable of suppressing variations in the hardenability of the metal pipe.

According to the forming device according to one embodiment of the present invention, when the gas is supplied from the gas supply unit into the metal pipe material and the metal pipe material is formed into the pipe portion in the first cavity portion, the controller controls the gas supply of the gas supply unit so as to maintain the pressure in the metal pipe material at the first pressure. Accordingly, it is possible to prevent pressure drop in the pipe portion caused by cooling of the pipe portion due to a contact between the first die and the second die forming the first cavity portion and the pipe portion. The pressure drop in the pipe portion is prevented, and thus, it is possible to suppress a decrease in a force for pressing the pipe portion against the first and second dies. Accordingly, it is possible to suppress a decrease in adhesion between the pipe portion, and the first die and the second die when the metal pipe is formed, and it is possible to suppress occurrence of variations in hardenability in the pipe portion of the metal pipe.

The first die and the second die may constitute a second cavity portion which communicates with the first cavity portion so as to form a flange portion of the metal pipe, in addition to the first cavity portion, and the controller may control the gas supply of the gas supply unit so as to expand a portion of the metal pipe material in the second cavity portion when the flange portion is formed from the metal pipe material before the pipe portion is formed. In this case, a portion of the metal pipe material in the second cavity portion is expanded before the pipe portion is formed, the expanded portion of the metal pipe material is pressed by the first die and the second die, and it is possible to form the flange portion. Accordingly, it is possible to easily form the flange portion and the pipe portion having a desired shape.

When the controller controls the gas supply of the gas supply unit to expand a portion of the metal pipe material so as to form the flange portion, the controller may control the gas supply of the gas supply unit so as to maintain the pressure of the gas in the metal pipe material at a second pressure lower than the first pressure. In this case, an expansion amount of a portion of the metal pipe material can be easily adjusted by a low-pressure gas, and the flange portion can be formed so as to have a desired size. In addition, the pipe portion having a desired shape can be formed by a high-pressure gas regardless of the flange portion. Accordingly, it is possible to more easily form the flange portion and the pipe portion having a desired shape.

When the gas is supplied from the gas supply unit into the metal pipe material, the controller may control the gas supply unit so as to intermittently supply the gas. In this case, the pressure of the gas in the metal pipe material can be easily maintained at a predetermined pressure.

The gas supply unit may include gas storage means for storing the gas, and the controller may supply the gas stored in the gas storage means into the metal pipe material so as to maintain the pressure of the gas in the metal pipe material at the first pressure. In this case, the pressure of the gas in the metal pipe material can be easily maintained at the first pressure.

According to a forming method according to another embodiment of the present invention, the pipe portion is formed in the first cavity portion by supplying the gas so as to maintain the pressure in the metal pipe material at the first pressure. Accordingly, it is possible to prevent pressure drop in the pipe portion caused by cooling of the pipe portion due to a contact between the first die and the second die forming the first cavity portion and the pipe portion. The pressure drop in the pipe portion is prevented, and thus, it is possible to suppress a decrease in a force for pressing the pipe portion against the first and second dies. Accordingly, it is possible to form the metal pipe while suppressing the decrease in the adhesion between the pipe portion, and the first die and the second die, and it is possible to suppress occurrence of variations in hardenability in the pipe portion of the metal pipe.

According to the present invention, it is possible to provide a forming device and a forming method capable of suppressing occurrence of variations in hardenability in a pipe portion of a main pipe.

Hereinafter, preferred embodiments of a forming device and a forming method according to the present invention will be described with reference to the drawings. In addition, in each drawing, the same reference numerals are assigned to the same portions or the corresponding portions, and overlapping descriptions thereof are omitted.

Configuration of Forming Device

FIG. 1 is a schematic configuration view of a forming device. As shown in FIG. 1, a forming device 10 for forming a metal pipe 100 (refer to FIG. 6) includes a blow forming die 13 including an upper die (first die) 12 and a lower die (second die) 11 which are paired with each other, a drive mechanism 80 which moves at least one of the upper die 12 and the lower die 11, a pipe holding mechanism (holding unit) 30 which holds a metal pipe material 14 between the upper die 12 and a lower die 11, a heating mechanism (heating unit) 50 which supplies power to the metal pipe material 14 held by the pipe holding mechanism 30 and heats the metal pipe material 14, a gas supply unit 60 which supplies a high-pressure gas (gas) into the metal pipe material 14 which is held between the upper die 12 and the lower die 11 and is heated, a pair of gas supply mechanisms 40 and 40 for supplying the gas from the gas supply unit 60 into the metal pipe material 14 held by the pipe holding mechanism 30, and a water circulation mechanism 72 which forcibly water-cools the blow forming die 13. In addition, the forming device 10 is configured to include a controller 70 which controls driving of the drive mechanism 80, driving of the pipe holding mechanism 30, driving of the heating mechanism 50, and gas supply of the gas supply unit 60.

The lower die (second die) 11 is fixed to a large base 15. The lower die 11 is configured of a large steel block and includes a cavity (recessed portion) 16 on an upper surface of the lower die 11. In addition, electrode receiving spaces 11*a* are provided around right and left ends (right and left ends in FIG. 1) of the lower die 11. The forming device 10 includes a first electrode 17 and a second electrode 18 which are configured so as to be movable upward or downward by an actuator (not shown) in the electrode receiving spaces 11*a*. Semicircular arc-shaped concave grooves 17*a* and 18*a* corresponding to a lower outer peripheral surface of the metal pipe material 14 are formed on upper surfaces of the first electrode 17 and the second electrode 18 (refer to FIG. 3C), and the metal pipe material 14 can be placed so as to be exactly fitted into the portions of the concave grooves 17*a* and 18*a*. In addition, a tapered concave surface 17*b* having a periphery inclined in a taper shape toward the concave groove 17*a* is formed on a front surface (a surface in an outside direction of the die) of the first electrode 17, and a tapered concave surface 18*b* having a periphery inclined in a taper shape toward the concave groove 18*a* is formed on a front surface (the surface in the outside direction of the die) of the second electrode 18. A cooling water passage 19 is formed in the lower die 11, and the lower die 11 includes a thermocouple 21 which is inserted from below at an approximately center. The thermocouple 21 is supported to be movable upward or downward by a spring 22.

In addition, the first and second electrodes 17 and 18 positioned on the lower die 11 side constitute the pipe holding mechanism 30, and can support the metal pipe material 14 between the upper die 12 and the lower die 11 such that the metal pipe material 14 can be lifted and lowered. In addition, the thermocouple 21 merely shows an example of temperature measuring means, and a non-contact type temperature sensor such as a radiant thermometer or a photo-thermometer may be used. If a correlation between an energization time and a temperature is obtained, it is sufficiently possible to eliminate the temperature measuring means.

The upper die (first die) 12 includes a cavity (recessed portion) 24 on a lower surface and is a large steel block which houses a cooling water passage 25. A slide 82 is fixed to an upper end portion of the upper die 12. In addition, the slide 82 to which the upper die 12 is fixed is configured to be suspended by a pressurizing cylinder 26, and is guided by a guide cylinder 27 so as not to sway.

Similarly to the lower die 11, electrode receiving spaces 12*a* are provided around right and left ends (right and left ends in FIG. 1) of the upper die 12. Similarly to the lower die 11, the forming device 10 includes a first electrode 17 and a second electrode 18 which are configured so as to be movable upward or downward by an actuator (not shown) in the electrode receiving spaces 12*a*. Semicircular arc-shaped concave grooves 17*a* and 18*a* corresponding to an upper outer peripheral surface of the metal pipe material 14 are formed on lower surfaces of the first electrode 17 and the second electrode 18 (refer to FIG. 3C), and the metal pipe material 14 can be exactly fitted into the concave grooves 17*a* and 18*a*. In addition, a tapered concave surface 17*b* having a periphery inclined in a taper shape toward the concave groove 17*a* is formed on a front surface (a surface in the outside direction of the die) of the first electrode 17, and a tapered concave surface 18*b* having a periphery inclined in a taper shape toward the concave groove 18*a* is formed on a front surface (the surface in the outside direction of the die) of the second electrode 18. Accordingly, the pair of first and second electrodes 17 and 18 positioned on the upper die 12 side also constitutes the pipe holding mechanism 30, and if the metal pipe material 14 is clamped from above and below by a pair of upper and lower first and second electrodes 17 and 18, the upper and lower first and second electrodes 17 and 18 can exactly surround the outer periphery of the metal pipe material 14 so as to come into close contact with the entire circumference of the metal pipe material 14.

The drive mechanism 80 includes the slide 82 which moves the upper die 12 such that the upper die 12 and the lower die 11 are joined to each other, a drive unit 81 which generates a driving force for moving the slide 82, and a servo motor 83 which controls a fluid volume with respect to the drive unit 81. The drive unit 81 is configured of a fluid supply unit which supplies a fluid (a working oil in a case where a hydraulic cylinder is adopted as the pressurizing cylinder 26) which drives the pressurizing cylinder 26 to the pressurizing cylinder 26.

The controller 70 controls the servo motor 83 of the drive unit 81 so as to control an amount of the fluid supplied to the pressurizing cylinder 26, and thus, can control the movement of the slide 82. In addition, it should be noted that the drive unit 81 is not limited to one that applies the driving force to the slide 82 via the pressurizing cylinder 26 as described above. For example, the drive unit 81 may be any one as long as it connects the drive mechanism to the slide 82 and directly or indirectly applies the driving force generated by the servo motor 83 to the slide 82. For example, a drive mechanism may be adopted, which includes an eccentric shaft, a drive source (for example, a servo motor, a speed reducer, or the like) which applies a rotation force by which the eccentric shaft is rotated, a conversion unit (for example, a connecting rod, an eccentric sleeve, or the like) which converts a rotation motion of the eccentric shaft into a linear motion and moves the slide. In addition, in the present embodiment, the drive unit 81 may not include the servo motor 83.

Figure 2:
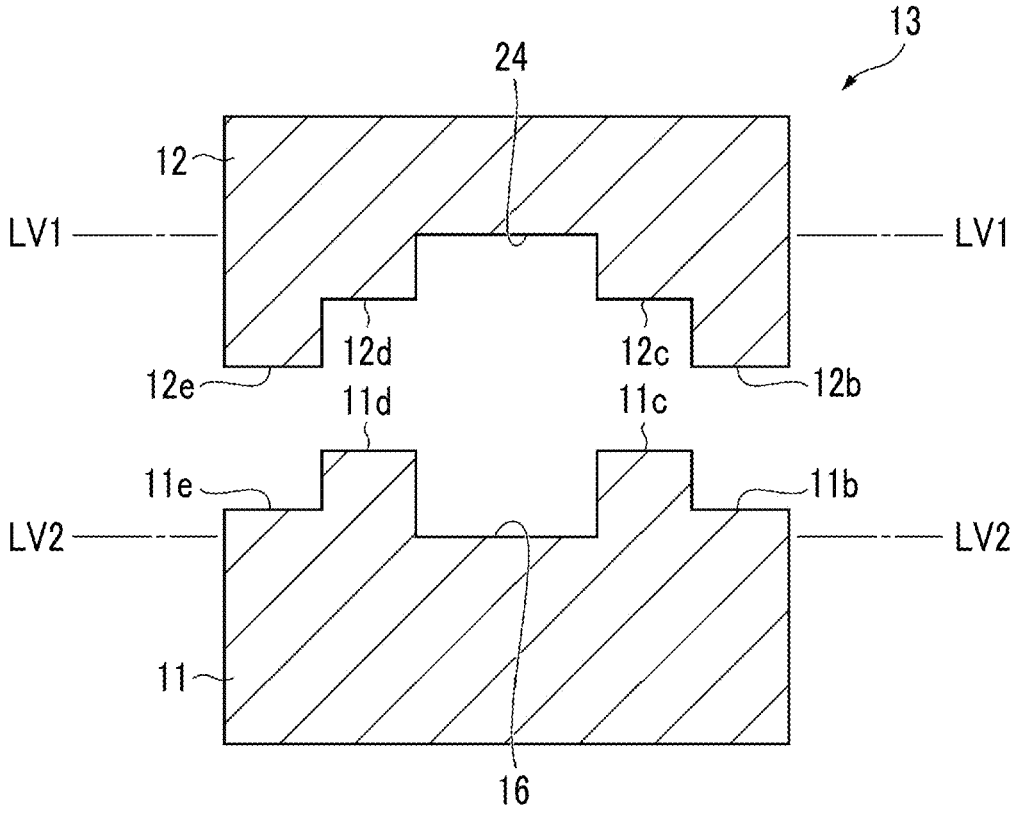
FIG. 2 is a sectional view of a blow forming die taken along line II-II shown in FIG. 1.

FIG. 2 is a sectional view of the blow forming die 13 taken along line II-II shown in FIG. 1. As shown in FIG. 2, steps are provided on both the upper surface of the lower die 11 and the lower surface of the upper die 12.

If a surface of the center cavity 16 of the lower die 11 is defined as a reference line LV2, the step is formed on the upper surface of the lower die 11 by a first protrusion 11*b*, a second protrusion 11*c*, a third protrusion 11*d*, and a fourth protrusion 11*e*. The first protrusion 11*b* and the second protrusion 11*c* are formed on a right side (a right side in FIG. 2 and a rear side of a paper surface in FIG. 2) of the cavity 16, and the third protrusion 11*d* and the fourth protrusion 11*e* are formed on a left side (a left side in FIG. 2 and a front side of the paper surface in FIG. 1) of the cavity 16. The second protrusion 11*c* is positioned between the cavity 16 and the first protrusion 11*b*. The third protrusion 11*d* is positioned between the cavity 16 and the fourth protrusion 11*e*. The second protrusion 11*c* and the third protrusion 11*d* respectively protrude toward the upper die 12 side from the first protrusion 11*b* and the fourth protrusion 11*e*. Protrusion amounts of the first protrusion 11*b* and the fourth protrusion 11*e* from the reference line LV2 are approximately the same as each other, and protrusion amounts of the second protrusion 11*c* and the third protrusion 11*d* from the reference line LV2 are approximately the same as each other.

Meanwhile, if a surface of the center cavity 24 of the upper die 12 is defined as a reference line LV1, the step is formed on the lower surface of the upper die 12 by a first protrusion 12*b*, a second protrusion 12*c*, a third protrusion 12*d*, and a fourth protrusion 12*e*. The first protrusion 12*b* and the second protrusion 12*c* are formed on a right side (a right side in FIG. 2) of the cavity 24, and the third protrusion 12*d* and the fourth protrusion 12*e* are formed on a left side (a left side in FIG. 2) of the cavity 24. The second protrusion 12*c* is positioned between the cavity 24 and the first protrusion 12*b*. The third protrusion 12*d* is positioned between the cavity 24 and the fourth protrusion 12*e*. The first protrusion 12*b* and the fourth protrusion 12*e* respectively protrude toward the lower die 11 side from the second protrusion 12*c* and the third protrusion 12*d*. Protrusion amounts of the first protrusion 12*b* and the fourth protrusion 12*e* from the reference line LV1 are approximately the same as each other, and protrusion amounts of the second protrusion 12*c* and the third protrusion 12*d* from the reference line LV1 are approximately the same as each other.

The first protrusion 12*b* of the upper die 12 faces the first protrusion 11*b* of the lower die 11, the second protrusion 12*c* of the upper die 12 faces the second protrusion 11*c* of the lower die 11, the cavity 24 of the upper die 12 faces the cavity 16 of the lower die 11, the third protrusion 12*d* of the upper die 12 faces the third protrusion 11*d* of the lower die 11, and the fourth protrusion 12*e* of the upper die 12 faces the fourth protrusion 11*e* of the lower die 11. In addition, a protrusion amount (a protrusion amount of the fourth protrusion 12*e* with respect to the third protrusion 12*d*) of the first protrusion 12*b* with respect to the second protrusion 12*c* in the upper die 12 is larger than a protrusion amount (a protrusion amount of the third protrusion 11*d* with respect to the fourth protrusion lie) of the second protrusion 11*c* with respect to the first protrusion 11*b* in the lower die 11. According, when the upper die 12 and the lower die 11 are fitted to each other, spaces are respectively formed between the second protrusion 12*c* of the upper die 12 and the second protrusion 11*c* of the lower die 11 and between the third protrusion 12*d* of the upper die 12 and the third protrusion 11*d* of the lower die 11 (refer to FIG. 8C). In addition, when the upper die 12 and the lower die 11 are fitted to each other, a space is formed between the cavity 24 of the upper die 12 and the cavity 16 of the lower die 11 (refer to FIG. 8C).

Figure 8A:
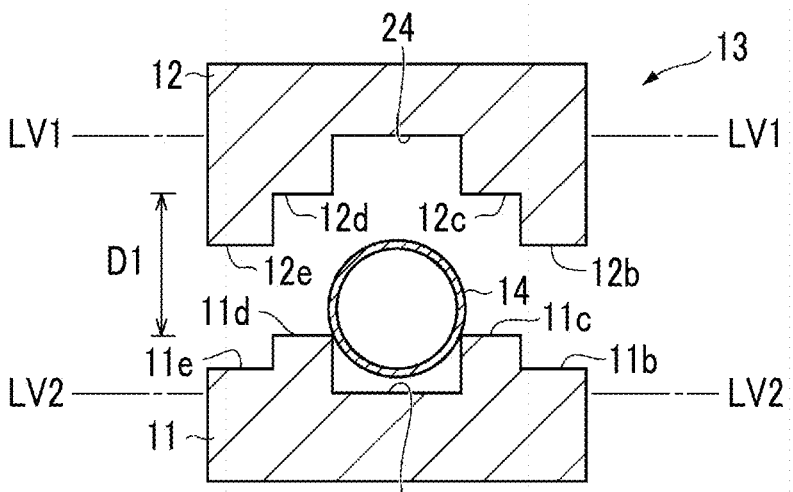
FIGS. 8A to 8D are views showing an operation of the blow forming die and a change of a shape of the metal pipe material.
Figure 8B:
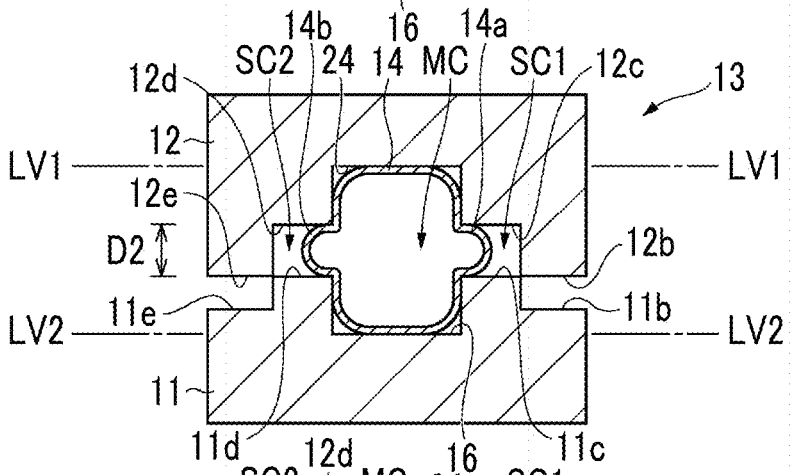
Figure 8C:
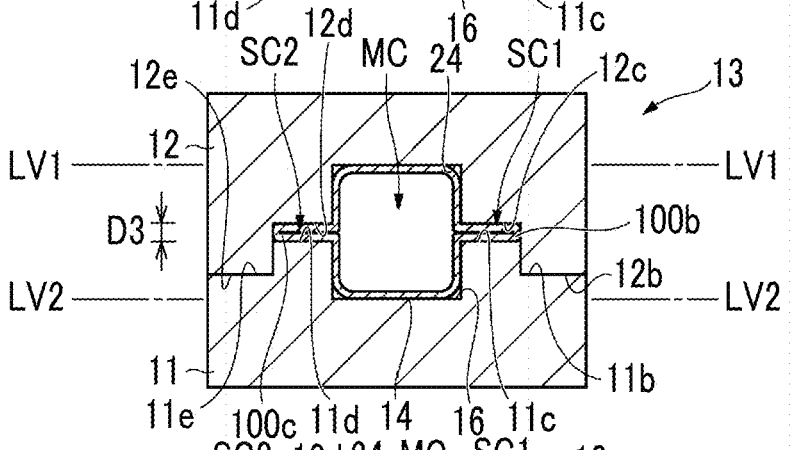
Figure 8D:
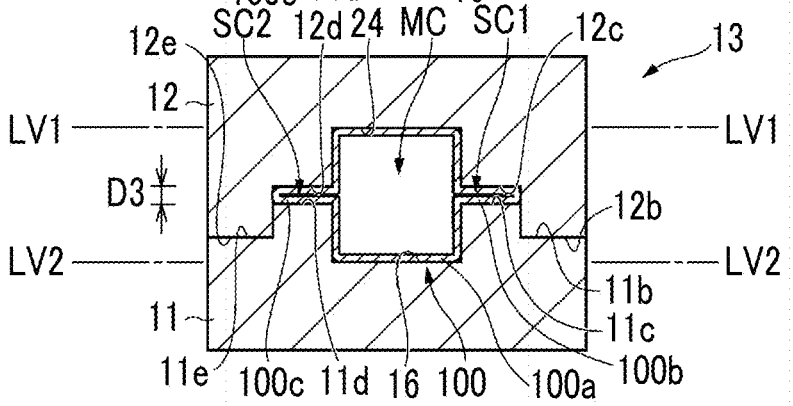

More specifically, when blow forming is performed, at a time before the lower die 11 and the upper die 12 are joined and fitted to each other, as shown in FIG. 8B, as shown in FIG. 8B, a main cavity portion (first cavity portion) MC is formed between a surface (a surface becoming the reference line LV1) of the cavity 24 of the upper die 12 and a surface (a surface becoming the reference line LV2) of the cavity 16 of the lower die 11. In addition, a sub cavity portion (second cavity portion) SC1 which communicates with the main cavity portion MC and has a volume smaller than that of the main cavity portion MC is formed between the second protrusion 12*c* of the upper die 12 and the second protrusion 11*c* of the lower die 11. Similarly, a sub cavity portion (second cavity portion) SC2 which communicates with the main cavity portion MC and has a volume smaller than that of the main cavity portion MC is formed between the third protrusion 12*d* of the upper die 12 and the third protrusion 11*d* of the lower die 11. The main cavity portion MC is a portion which forms a pipe portion 100*a* in the metal pipe 100 and sub cavity portions SC1 and SC2 are portions which respectively form flange portions 100*b* and 100*c* in the metal pipe 100 (refer to FIGS. 8C and 8D). In addition, as shown in FIGS. 8C and 8D, in a case where the lower die 11 and the upper die 12 are joined (fitted) to each other so as to be completely closed, the main cavity portion MC and the sub cavity portions SC1 and SC2 are sealed in the lower die 11 and the upper die 12.

As shown in FIG. 1, the heating mechanism 50 includes a power supply 51, conducting wires 52 which extend from the power supply 51 and are connected to the first electrode 17 and the second electrode 18, and a switch 53 which is interposed between the conducting wires 52. The controller 70 controls the heating mechanism 50, and thus, the metal pipe material 14 can be heated to a quenching temperature (above an AC3 transformation point temperature).

Figure 3A:
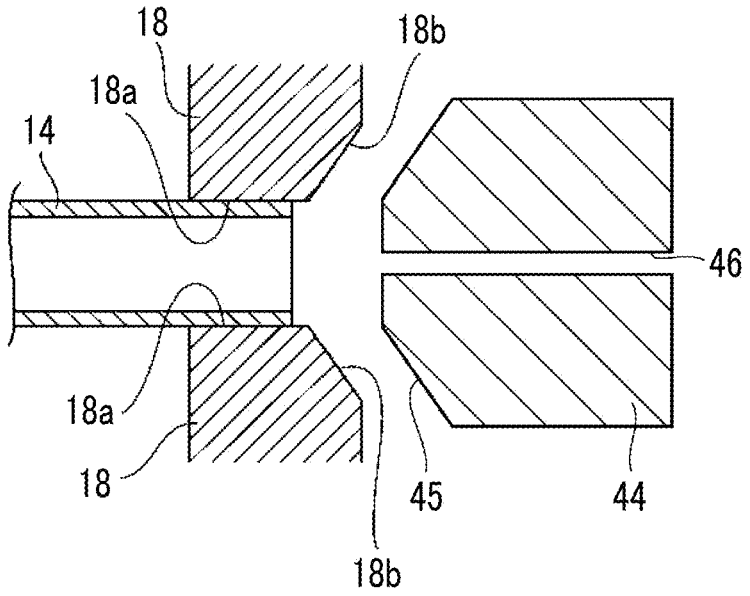
FIG. 3A is a view showing a state where an electrode holds a metal pipe material.
Figure 3B:
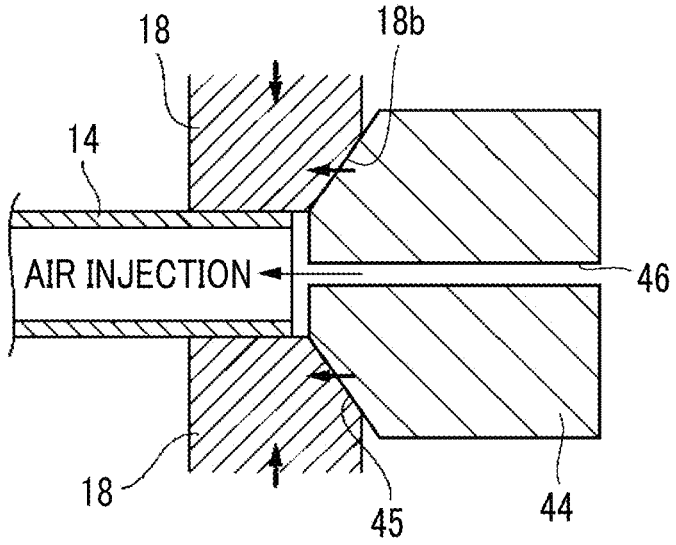
FIG. 3B is a state where a seal member abuts against the electrode.
Figure 3C:
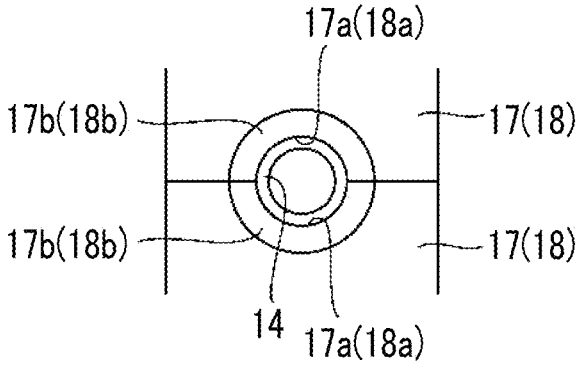
FIG. 3C is a front view of the electrode.

Each of the pair of gas supply mechanisms 40 includes a cylinder unit 42, a cylinder rod 43 which moves forward and rearward in accordance with an operation of the cylinder unit 42, and a seal member 44 connected to a tip of the cylinder rod 43 on the pipe holding mechanism 30 side. The cylinder unit 42 is placed on and fixed to the base 15 via a block 41. At a tip of each seal member 44, a tapered surface 45 is formed to be tapered. One tapered surface 45 is configured to have a shape which can be exactly fitted to the tapered concave surface 17*b* of the first electrode 17 so as to abut against the tapered concave surface 17*b*, and the other tapered surface 45 is configured to have a shape which can be exactly fitted to the tapered concave surface 18*b* of the second electrode 18 so as to abut against the tapered concave surface 17*b* (refer to FIG. 3A to 3C). The seal member 44 extends from the cylinder unit 42 side toward the tip. More specifically, as shown in FIGS. 3A and 3B, a gas passage 46 through which a high-pressure gas supplied form the gas supply unit 60 flows is provided.

Returning to FIG. 1, the gas supply unit 60 includes a gas source 61, an accumulator 62 in which the gas supplied by the gas source 61 is stored, a first tube 63 which extends from the accumulator 62 to the cylinder unit 42 of the gas supply mechanism 40, a pressure control valve 64 and a switching valve 65 which are interposed in the first tube 63, a second tube 67 which extends from the accumulator 62 to the gas passage 46 formed in the seal member 44, and a pressure control valve 68 and a check valve 69 which are interposed in the second tube 67. The pressure control valve 64 plays a role of supplying gas of an operating pressure adapted to a pushing force of the seal member 44 with respect to the metal pipe material 14 to the cylinder unit 42. The check valve 69 plays a role of preventing the gas from back-flowing in the second tube 67.

Figure 4:
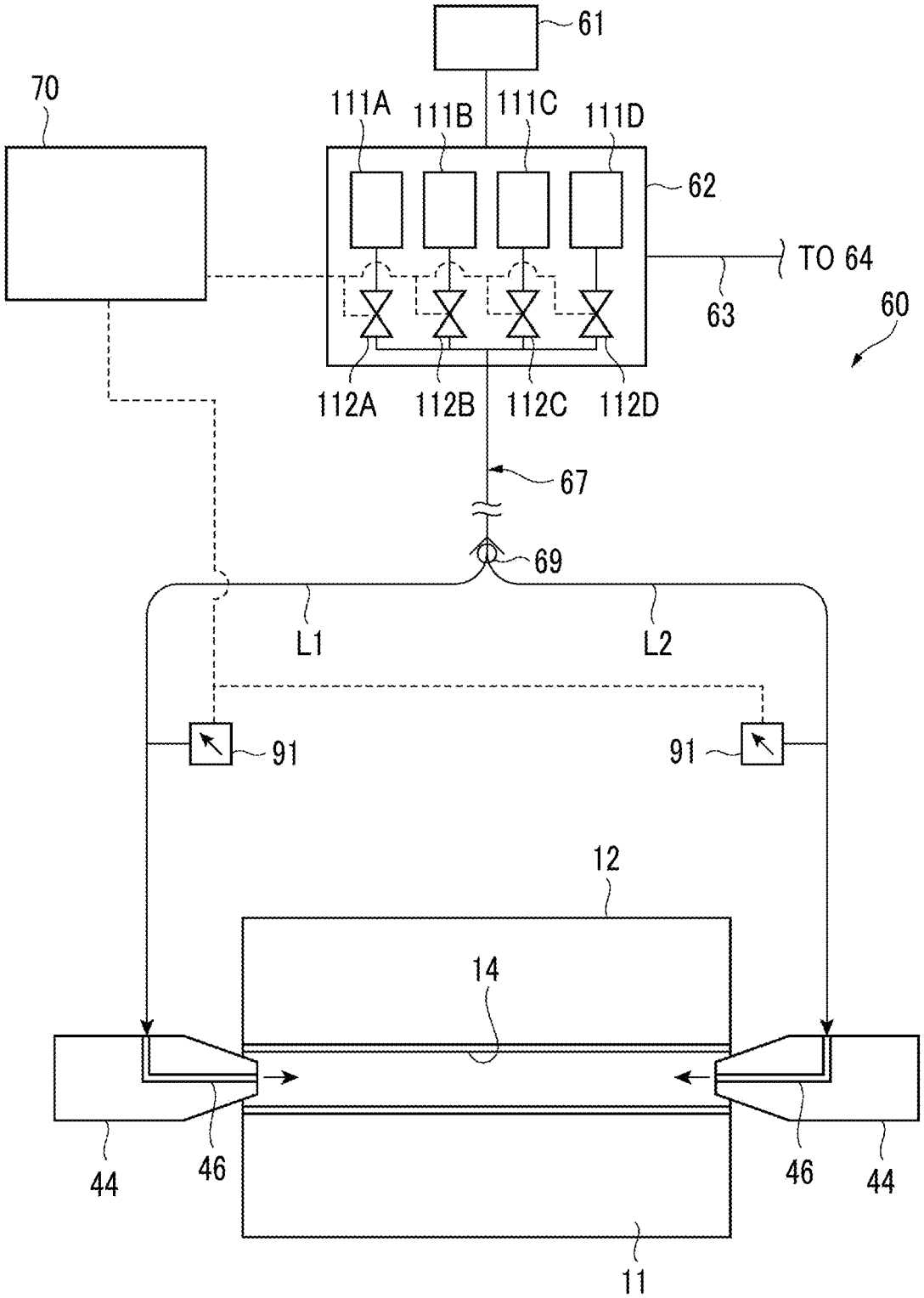
FIG. 4 is a schematic view explaining a configuration of an accumulator of the gas supply unit.

As shown in FIG. 4, the accumulator 62 has gas tanks 111A to 111D which are gas storage means for storing the gas and on/off valves 112A to 112D whose on/off states are controlled by the controller 70. The gas tank 111A is connected to the gas source 61 and is connected to the second tube 67 via the on/off valve 112A. Similarly, each of the gas tanks 111B to 111D is connected to the gas source 61 and is connected to the second tube 67 via the corresponding on/off valves 112B to 112D. Accordingly, the supply of the gas, which is supplied from the gas source 61 and stored in the gas tanks 111A to 111D, to the second tube 67 is controlled by the corresponding on/off valves 112A to 112D. In addition, the on/off valves 112A to 112D are controlled independently by the controller 70.

The pressures of the gases stored in the gas tanks 111A and 111B are the same as each other, and the pressures of the gases stored in the gas tanks 111C and 111D are the same as each other. The gas stored in the gas tanks 111A and 111B is a gas (hereinafter, referred to as a low-pressure gas) having an operating pressure for expanding portions 14*a* and 14*b* (refer to FIG. 8B) of the metal pipe material 14. Meanwhile, the gas stored in the gas tanks 111C and 111D is a gas (hereinafter, referred to as a high-pressure gas) having an operating pressure for forming the pipe portion 100*a* (refer to FIG. 8D) of the metal pipe 100. For example, the pressure (first pressure P1, refer to FIG. 7) of the high-pressure gas is about 2 to 5 times the pressure (second pressure P2, refer to FIG. 7) of the low pressure gas. In addition, each of the first pressure P1 and the second pressure P2 may not be a pressure value indicating a certain point. For example, it is preferable that each of the first pressure P1 and the second pressure P2 is within a range of 80% to 120% from a reference pressure value. As a specific example, in a case where a reference of the pressure for forming the pipe portion 100*a* is set to 10 MPa, preferably, the first pressure P1 is within a range of 8 MPa to 12 MPa.

The second tube 67 branches off from the check valve 69 in two branches, and includes a first supply line L1 which extends to one gas supply mechanism 40 and a second supply line L2 which extends to the other gas supply mechanism 40. A pressure sensor 91 for detecting the pressure of the gas flowing through the lines L1 and L2 is attached to each of the first supply line L1 and the second supply line L2.

The controller 70 controls on/off of the on/off valves 112A to 112D of the accumulator 62 and on/off of the pressure control valve 68 according to a pressure change of the gas detected by the pressure sensor 91. In this case, the controller 70 intermittently switches the on/off of the on/off valves 112A to 112D based on a detection result of the pressure sensor 91 so as to control the gas supply of the gas supply unit 60. In this manner, the controller 70 controls the gas supply of the gas supply unit 60 such that the pressure of the gas in the metal pipe material 14 at the time of the expansion is maintained at the first pressure P1 or the second pressure P2. For example, when the pressure of the gas in the metal pipe material 14 reaches the maximum value within a range defined as the first pressure P1, the controller 70 controls the pressure control valve 68 such that the pressure control valve 68 is turned off. In addition, when the pressure of the gas in the metal pipe material 14 reaches the minimum value within the range defined as the first pressure P 1, the controller 70 controls the pressure control valve 68 such that the pressure control valve 68 is turned on.

Information is transmitted to the controller 70 from (A) shown in FIG. 1, and thus, the controller 70 acquires temperature information from the thermocouple 21 and controls the pressurizing cylinder 26, the switch 53, or the like. The water circulation mechanism 72 includes a water tank 73 which stores water, a water pump 74 which pumps up the water stored in the water tank 73, pressurizes the water, and feeds the pressurized water to the cooling water passage 19 of the lower die 11 and the cooling water passage 25 of the upper die 12, and a pipe 75. Although omitted, a cooling tower for lowering a water temperature and a filter for purifying the water may be interposed in the pipe 75.

Forming Method of Metal Pipe Using Forming Device

Figure 5A:
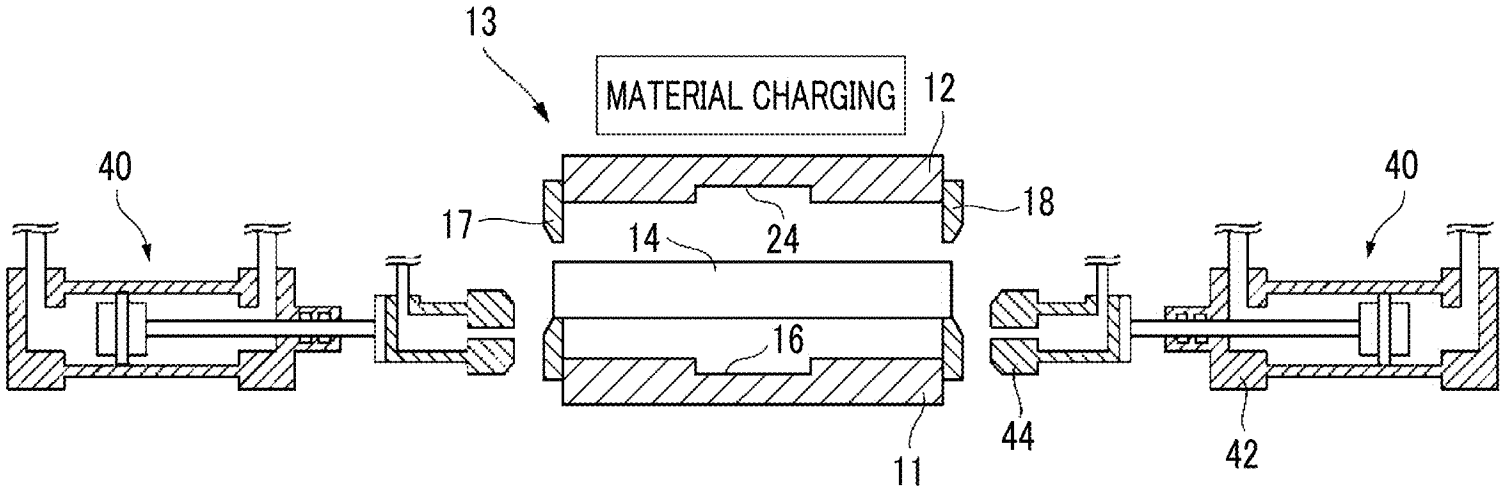
FIG. 5A is a view showing a state where the metal pipe material is set in a die in a manufacturing step performed by the forming device and FIG. 5B is a view showing a state where the metal pipe material is held by the electrode in the manufacturing step performed by the forming device.
Figure 5B:
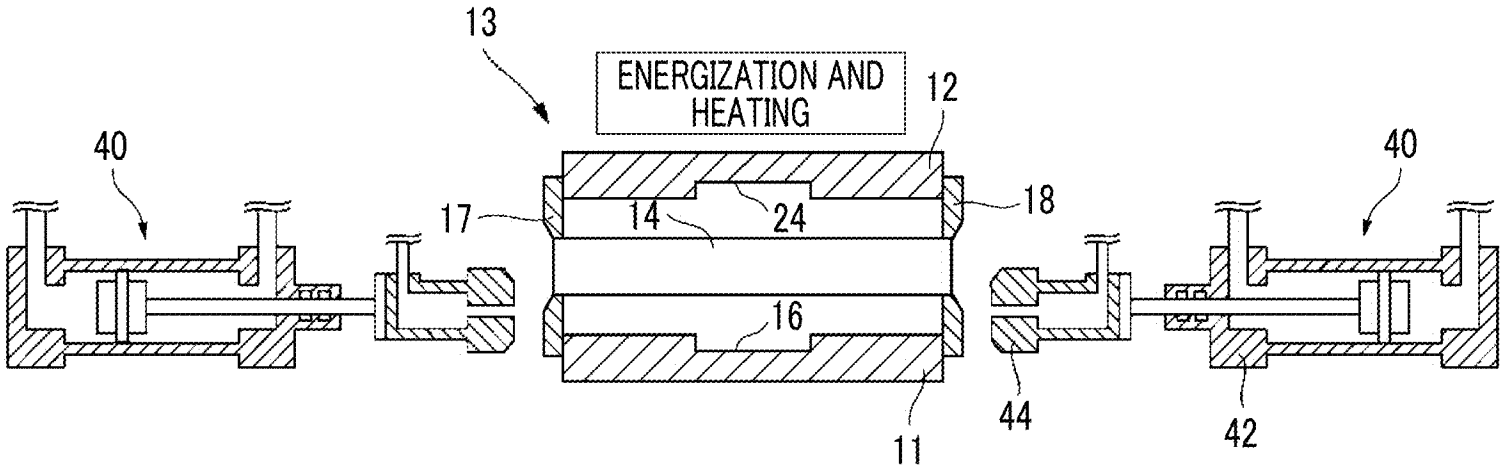

Next, a forming method of the metal pipe using the forming device 10 will be described. FIG. 5 shows steps from a pipe charging step of charging the metal pipe material 14 as a material to an energizing/heating step of energizing and heating the metal pipe material 14. Initially, the metal pipe material 14 of a hardenable steel type is prepared. As shown in FIG. 5A, for example, the metal pipe material 14 is placed on (charged in) the first and second electrodes 17 and 18, which are provided on the lower die 11 side, using a robot arm or the like. The concave grooves 17*a* and 18*a* are respectively formed on the first and second electrodes 17 and 18, and thus, the metal pipe material 14 is positioned by the concave grooves 17*a* and 18*a*. Next, the controller 70 (refer to FIG. 1) controls the pipe holding mechanism 30, and thus, the metal pipe material 14 is held by the pipe holding mechanism 30. Specifically, as shown in FIG. 5B, an actuator (not shown) which can move the first electrode 17 and the second electrode 18 forward or rearward is operated, and thus, the first and second electrodes 17 and 18 positioned above and below approach each other and abut against each other. According to this abutment, both end portions of the metal pipe material 14 are clamped from above and below by the first and second electrodes 17 and 18. In addition, this clamping is performed in an aspect in which the concave grooves 17*a* and 18*a* respectively formed on the first and second electrodes 17 and 18 are provided such that the first and second electrodes 17 and 18 come into close contact with the entire circumference of the metal pipe material 14. However, the present invention is not limited to the configuration in which the first and second electrodes 17 and 18 come into close contact with the entire circumference of the metal pipe material 14. That is, the first and second electrodes 17 and 18 may abut against a portion of the metal pipe material 14 in the circumferential direction.

Subsequently, as shown in FIG. 1, the controller 70 controls the heating mechanism 50 so as to heat the metal pipe material 14. Specifically, the controller 70 turns on the switch 53 of the heating mechanism 50. Accordingly, power from the power supply 51 is supplied to the metal pipe material 14, and the metal pipe material 14 itself is heated (Joule heat) by a resistance existing in the metal pipe material 14. In this case, a measurement value of the thermocouple 21 is always monitored, and the energization is controlled based on this result.

Figure 6:
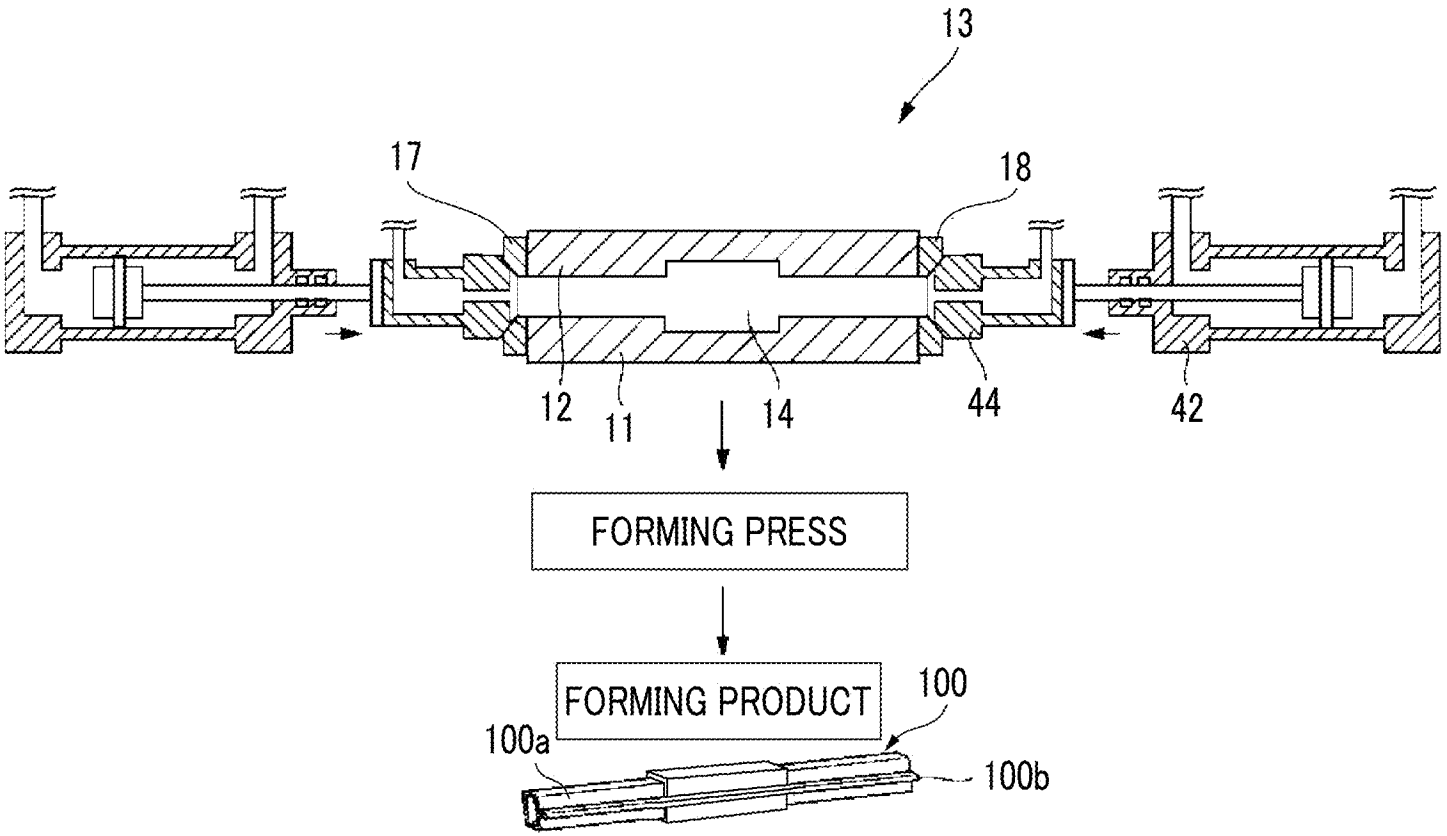
FIG. 6 is a view showing an outline of a blow forming step performed by the forming device and a flow after the blow forming step.

FIG. 6 is a view showing an outline of a blow forming step performed by the forming device and a flow after the blow forming step. As shown in FIG. 6, the blow forming die 13 is closed with respect to the heated metal pipe material 14, and the metal pipe material 14 is disposed in the cavity of the blow forming die 13 and is sealed. Thereafter, the cylinder unit 42 of the gas supply mechanism 40 is operated, and thus, both ends of the metal pipe material 14 are sealed by the seal members 44 (also refer to FIGS. 3A to 3C). After the sealing is completed, the blow forming die 13 is closed, the gas is sucked into the metal pipe material 14, and the heated and softened metal pipe material 14 is formed according to a shape of the cavity (a specific forming method of the metal pipe material 14 will be described later).

The metal pipe material 14 is heated to a high temperature (approximately 950° C.) and softened, and thus, the gas supplied into the metal pipe material 14 thermally expands. Accordingly, for example, the supplied gas serves as compressed air or compressed nitrogen gas, the metal pipe material 14 having a temperature of 950° C. is easily expanded by the compressed air which is thermally expanded, and the metal pipe 100 can be obtained.

Specifically, an outer peripheral surface of the blow-formed and expanded metal pipe material 14 comes into contact with the cavity 16 of the lower die 11 so as to be rapidly cooled and comes into contact with the cavity 24 of the upper die 12 so as to be rapidly cooled (the upper die 12 and the lower die 11 have a large heat capacity and are controlled to a low temperature, and thus, if the metal pipe material 14 comes into contact with the upper die 12 and the lower die 11, a heat of a pipe surface is taken to the die side at once), and thus, hardening is performed on the metal pipe material 14. The above-described cooling method is referred to as die contact cooling or die cooling. Immediately after being rapidly cooled, austenite transforms into martensite (hereinafter, transformation from austenite to martensite is referred to as martensitic transformation). The cooling rate decreased in a second half of the cooling, and thus, martensite transforms into another structure (such as troostite, sorbite, or the like) due to recuperation. Therefore, it is not necessary to separately perform tempering treatment. In addition, in the present embodiment, the cooling may be performed by supplying a cooling medium to the metal pipe 100, instead of or in addition to the cooling of the die. For example, in order to perform the cooling, the metal pipe material 14 comes into contact with the die (upper die 12 and lower die 11) until a temperature at which the martensitic transformation starts, and thereafter, the die is opened and a cooling medium (cooling gas) is blown onto the metal pipe material 14, and thus, the martensitic transformation is generated.

Figure 7:
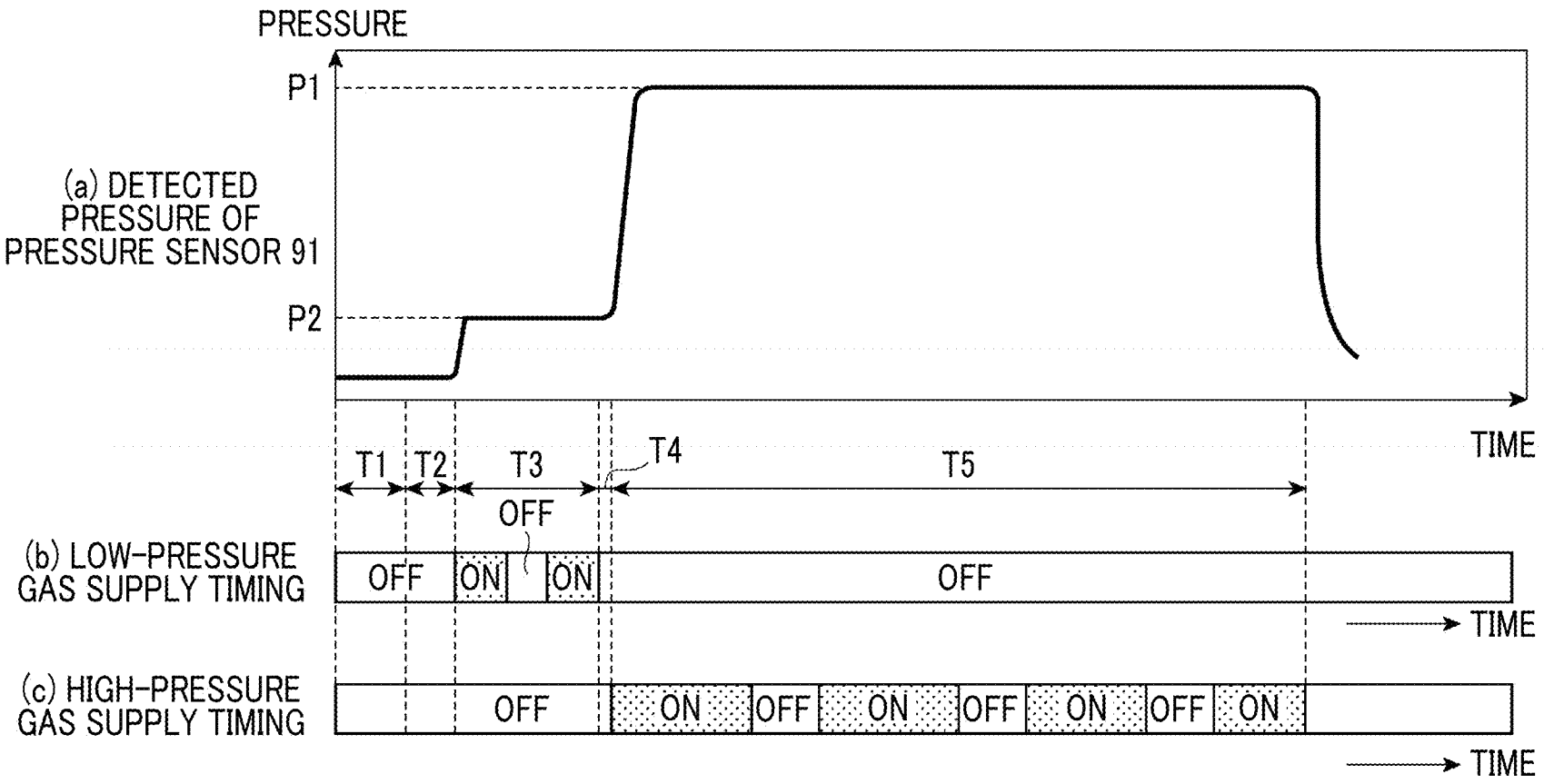
FIG. 7 is a timing chart showing a relationship between a detected pressure of a pressure sensor and gas supply in the blow forming step performed by the forming device.

Next, with reference to FIGS. 7 and 8A to 8D, an example of a specific forming aspect performed by the upper die 12 and the lower die 11 will be described in detail. FIG. 7 is a timing chart showing a relationship between a detected pressure of the pressure sensor and the gas supply in the blow forming step performed by the forming device. In FIG. 7, (a) shows a temporal change of the detected pressure of the pressure sensor 91, (b) shows a supply timing of the low-pressure gas, and (c) shows a supply timing of the high-pressure gas. As shown in FIGS. 7 and 8A, in a period T1 of FIG. 7, the heated metal pipe material 14 is prepared between the cavity 24 of the upper die 12 and the cavity 16 of the lower die 11. For example, the metal pipe material 14 is supported by the second protrusion 11*c* and the third protrusion 11*d* of the lower die 11. In addition, a distance between the second protrusion 12*c* of the upper die 12 and the second protrusion 11*c* of the lower die 11 in the period T1 is D1 (see FIG. 8A).

Next, in a period T2 after the period T1 shown in FIG. 7, the drive mechanism 80 moves the upper die 12 in a direction in which the upper die 12 is to be joined to the lower die 11. As a result, in a period T3 after the period T2 shown in FIG. 7, as shown in FIG. 8B, the upper die 12 and the lower die 11 are not completely closed, and a distance between the second protrusion 12*c* of the upper die 12 and the second protrusion 11*c* of the lower die 11 is D2 (D2<D1). The main cavity portion MC is formed between the surface of the reference line LV1 of the cavity 24 and the surface of the reference line LV2 of the cavity 16. In addition, the sub cavity portion SC1 is formed between the second protrusion 12*c* of the upper die 12 and the second protrusion 11*c* of the lower die 11, and the sub cavity portion SC2 is formed between the third protrusion 12*d* of the upper die 12 and the third protrusion 11*d* of the lower die 11. The main cavity portion MC and the sub-cavity portions SC1 and SC2 are in a state of communicating with each other. In this case, an inner edge of the first protrusion 12*b* of the upper die 12 and an outer edge of the second protrusion 11*c* of the lower die 11 come into close contact with each other, an inner edge of the fourth protrusion 12*e* of the upper die 12 and an outer edge of the third protrusion 11*d* of the lower die 11 come into close contact with each other, and thus, the main cavity portion MC and the sub cavity portions SC1 and SC2 are sealed to the outside. In addition, a space (clearance) is provided between the first protrusion 12*b* of the upper die 12 and the first protrusion 11*b* of the lower die 11, and a space (clearance) is provided between the fourth protrusion 12*e* of the upper die 12 and the fourth protrusion 11*e* of the lower die 11, respectively.

In addition, during the period T 3, the low-pressure gas is supplied to the inside of the metal pipe material 14 softened by heating of the heating mechanism 50 through the gas supply unit 60. This low-pressure gas is the gas accumulated in the gas tanks 111A and 111B provided in the accumulator 62 of the gas supply unit 60. The supply of the low-pressure gas by the gas supply unit 60 is controlled by the on/off valves 112A and 112B and the pressure control valve 68. In this case, under the control of the controller 70, the gas supply unit 60 intermittently supplies the low-pressure gas into the metal pipe material 14 so as to maintain the pressure of the low-pressure gas detected by the pressure sensor 91 at the second pressure P2. By the supply of the low-pressure gas, the metal pipe material 14 expands in the main cavity portion MC as shown in FIG. 8B. In addition, portions (both side portions) 14*a* and 14*b* of the metal pipe material 14 expands so as to enter the sub-cavity portions SC1 and SC2 communicating with the main cavity portion MC, respectively.

Next, in a period T4 after the period T3 shown in FIG. 7, the upper die 12 is moved by the drive mechanism 80. More specifically, the upper die 12 is moved by the drive mechanism 80, and as shown in FIG. 8C, the upper die 12 and the lower die 11 are fitted (clamped) to each other such that a distance between the second protrusion 12*c* of the upper die 12 and the second protrusion 11*c* of the lower die 11 is D3 (D3<D2). In this case, the first protrusion 12*b* of the upper die 12 and the first protrusion 11*b* of the lower die 11 come into close contact with each other without gaps, and the fourth protrusion 12*e* of the upper die 12 and the fourth protrusion 11*e* of the lower die 11 come into close contact with each other without gaps. By driving the drive mechanism 80, portions 14*a* and 14*b* of the expanded metal pipe material 14 is pressed by the upper die 12 and the lower die 11 to form the flange portion 100*b* of the metal pipe 100 in the sub cavity portion SC1 and the flange portion 100*c* of the metal pipe 100 in the sub cavity portion SC2. The flange portions 100*b* and 100*c* are formed by folding a portion of the metal pipe material 14 along a longitudinal direction of the metal pipe 100 (refer to FIG. 6).

Next, during a period T5 after the period T4 shown in FIG. 7, after the flange portions 100*b* and 100*c* are formed, the high-pressure gas is supplied to the inside of the metal pipe material 14 by the gas supply unit 60. This high-pressure gas is the gas accumulated in the gas tanks 111C and 111D of the accumulator 62 of the gas supply unit 60. The supply of the high-pressure gas by the gas supply unit 60 is controlled by on/off valves 112C and 112D and the pressure control valve 68. In this case, under the control of the controller 70, the gas supply unit 60 intermittently supplies the high-pressure gas into the metal pipe material 14 so that the pressure of the high-pressure gas detected by the pressure sensor 91 is maintained at the first pressure P1. By the supply of the high-pressure gas, the metal pipe material 14 in the main cavity portion MC expands and the pipe portion 100*a* of the metal pipe 100 is formed as shown in FIG. 8D. In addition, a supply time of the high-pressure gas in the period T5 is longer than a supply time of the low-pressure gas in the period T3. Accordingly, the metal pipe material 14 expands sufficiently to reach every corner of the main cavity portion MC, and the pipe portion 100*a* follows the shape of the main cavity portion MC defined by the upper die 12 and the lower die 11.

Through the above-described periods T1 to T5, it is possible to finish the metal pipe 100 having the pipe portion 100*a* and the flange portions 100*b* and 100*c*. In general, a time from the blow forming of the metal pipe material 14 to the completion of the formation of the metal pipe 100 is approximately several seconds to several tens of seconds depending on the type of the metal pipe material 14. In the example shown in FIG. 8D, the main cavity portion MC is formed in a rectangular cross section, and thus, the metal pipe material 14 is blow-formed according to the shape such that the pipe portion 100*a* is formed in a rectangular tubular shape. However, the shape of the main cavity portion MC is not particularly limited, and any shape such as a circular cross section, an elliptical cross section, or a polygonal cross section may be adopted according to a desired shape.

Next, operation and effects of the forming device 10 according to the present embodiment and the forming method using the forming device 10 will be described while comparing with a comparative example.

Figure 9:
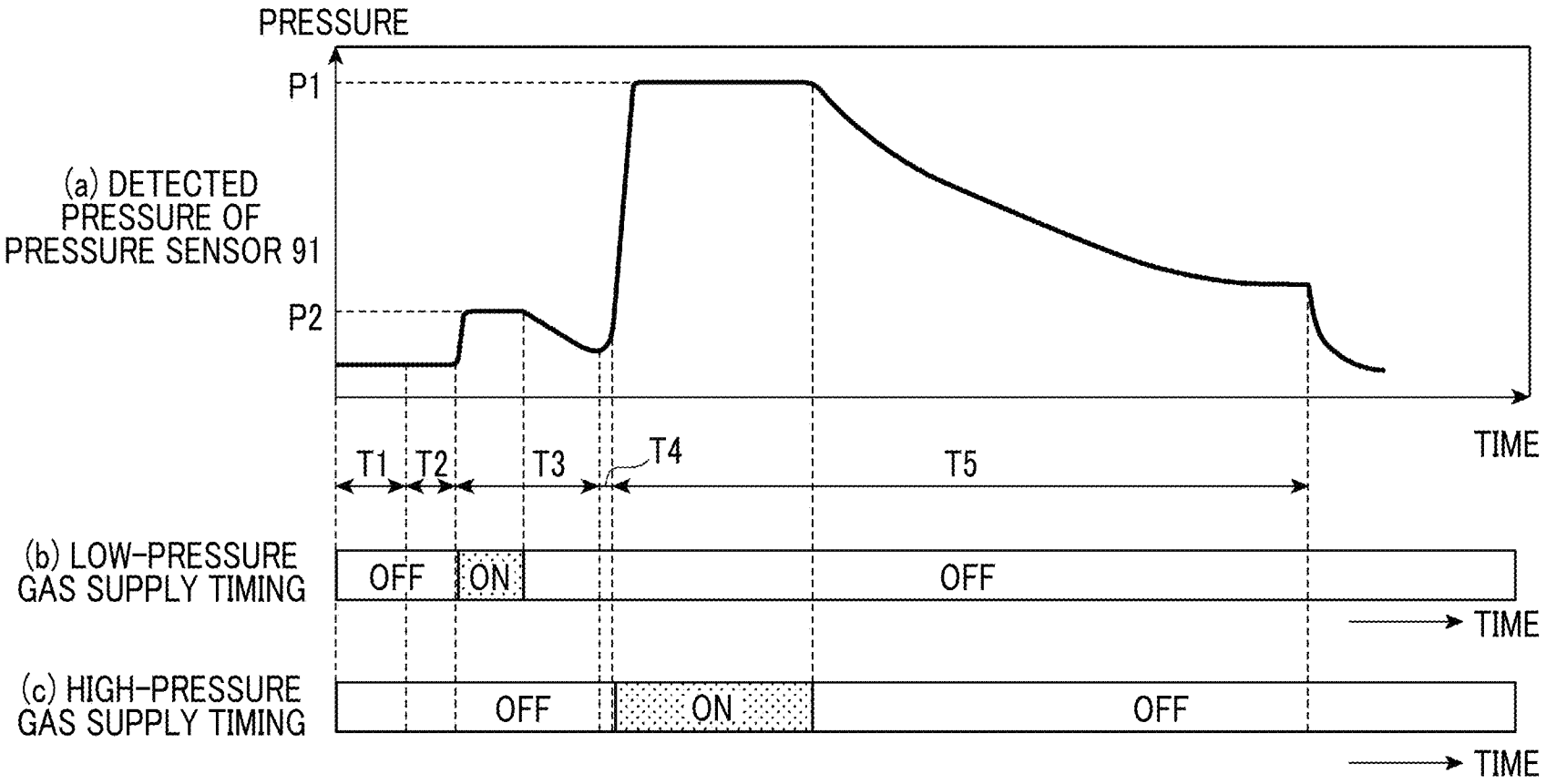
FIG. 9 is a timing chart showing a relationship between a detected pressure of a pressure sensor and gas supply in a blow forming step according to a comparative example.

First, referring to FIG. 9, a forming method using a forming device according to a comparative example will be described. A controller of a forming device according to the comparative example controls to supply a low-pressure gas and a high-pressure gas by a gas supply unit until the lower-pressure gas and the high-pressure gas respectively reach predetermined values. Accordingly, as shown in FIG. 9, in the period T3 in the comparative example, the pressure in the metal pipe material 14 is temporarily set to the second pressure P2, and thereafter, the gas supply of the gas supply unit is stopped. That is, even if the pressure in the metal pipe material 14 subsequently falls outside a range of the second pressure P2, the gas supply unit does not perform the gas supply again. In this case, the expansion amounts of the portions 14*a* and 14*b* of the metal pipe material 14 entering the sub-cavity portions SC1 and SC2 are smaller than those of the forming method of the present embodiment. Accordingly, if the small expanded portions 14*a* and 14*b* of the metal pipe material 14 are pressed by the upper die 12 and the lower die 11, the flange portions 100*b* and 100*c* do not have sufficient sizes.

Similarly to the period 3, in the period T5 in the comparative example, the pressure in the metal pipe material 14 is temporarily set to the first pressure P1, and thereafter, the gas supply of the gas supply unit is stopped. That is, after the pressure in the metal pipe material 14 is temporarily set to the first pressure P1, even when the pressure in the metal pipe material 14 subsequently falls outside a range of the first pressure P1, the gas supply unit does not perform the gas supply again. In this case, after the gas supply of the gas supply unit is stopped, a force for pressing the pipe portion against the first and second dies by the gas decreases in accordance with a pressure drop of the gas in the pipe portion 100*a* of the metal pipe 100 formed in the main cavity portion MC. Accordingly, when the hardening of the pipe portion 100*a* is performed by the upper die 12 and the lower die 11, adhesion between the metal pipe 100, and the upper die 12 and the lower die 11 decreases, and variations in hardenability of the metal pipe 100 occur.

Meanwhile, according to the forming device 10 of the present embodiment, when the controller 70 causes the gas supply unit 60 to supply the high-pressure gas into the metal pipe material 14 to form the metal pipe material 14 into the pipe portion 100*a* in the main cavity portion MC, the controller 70 controls the gas supply is controlled so as to maintain the pressure in the metal pipe material 14 at the first pressure P1. Accordingly, it possible to prevent pressure drop in the pipe portion 100*a* caused by cooling of the pipe portion 100*a* due to a contact between the upper die 12 and the lower die 11 forming the main cavity portion MC, and the pipe portion 100*a*. The pressure drop in the pipe portion 100*a* is prevented, and thus, it is possible to suppress a decrease in a force for pressing the pipe portion 100*a* against the upper die 12 and the lower die 11. Accordingly, when the metal pipe 100 is formed, it is possible to suppress the decrease in the adhesion between the pipe portion 100*a*, and the upper die 12 and the lower die 11, and it is possible to suppress occurrence of variations in hardenability in the pipe portion 100*a* of the metal pipe 100.

The upper die 12 and the lower die 11 constitutes the sub cavity portions SC1 and SC2 which communicate with the main cavity portion MC so as to form the flange portions 100*b* and 100*c* of the metal pipe 100, in addition to the main cavity portion MC, and the controller 70 controls the gas supply of the gas supply unit 60 so as to expand the portions 14*a* and 14*b* of the metal pipe material 14 into the sub cavity portions SC1 and SC2 when the flange portions 100*b* and 100*c* are formed from the metal pipe material 14 before the pipe portion 100*a* is formed. Accordingly, the portions 14*a* and 14*b* of the metal pipe material 14 in the sub cavity portions SC1 and SC2 are respectively expanded before the pipe portion 100*a* is formed, the expanded portions 14*a* and 14*b* of the metal pipe material 14 are pressed by the upper die 12 and the lower die 11, and it is possible to form the flange portions 100*b* and 100*c*. Accordingly, it is possible to easily form the flange portions 100*b* and 100*c* and the pipe portion 100*a* having a desired shape.

When the controller 70 controls the gas supply of the gas supply unit 60 to expand the portions 14*a* and 14*b* of the metal pipe material 14 so as to form the flange portions 100*b* and 100*c*, the controller 70 controls the gas supply of the gas supply unit 60 so as to maintain the pressure of the low-pressure gas in the metal pipe material 14 at the second pressure P2 lower than the first pressure P1. Accordingly, the expansion amounts of the portions 14*a* and 14*b* of the metal pipe material 14 can be easily adjusted by the stabilized low-pressure gas, and the flange portions 100*b* and 100*c* can be formed so as to have a desired size. In addition, the pipe portion 100*a* having a desired shape can be formed by the high-pressure gas regardless of the flange portions 100*b* and 100*c*. Accordingly, it is possible to more easily form the flange portion 100*b* and 100*c* and the pipe portion 100*a* having a desired shape.

When the low-pressure gas or the high-pressure gas is supplied from the gas supply unit 60 into the metal pipe material 14, the controller 70 controls the gas supply unit 60 so as to intermittently supply the gas. Accordingly, the pressure of the gas in the metal pipe material 14 can be easily maintained at the first pressure P1 or the second pressure P2.

The gas supply unit 60 includes the gas tanks 111A to 111D serving as the gas storage means for storing the gas, and the controller 70 supplies the gas stored in at least one of the gas tanks 111C and 111D into the metal pipe material 14 so as to maintain the pressure of the gas in the metal pipe material 14 at the first pressure P1. Accordingly, the pressure of the gas in the metal pipe material 14 can be easily maintained at the first pressure P1.

Next, with reference to FIGS. 10 and 11A to 11C, a forming method of a metal pipe 100A (refer to FIG. 11C) which does not have the flange portions 100*b* and 100*c* will be described. In order to the metal pipe 100A, as shown in FIGS. 11A to 11C, the lower die 11 which does not have the first protrusion 11*b*, the second protrusion 11*c*, the third protrusion 11*d*, and the fourth protrusion 11*e* and the upper die 12 which does not have the first protrusion 12*b*, the second protrusion 12*c*, the third protrusion 12*d*, and the fourth protrusion 12*e* are used. In addition, the flange portions are not provided in the metal pipe 100A, and thus, the accumulator 62 may not have the gas tanks 111A and 111B and the on/off valves 112A and 112B.

Figure 10:
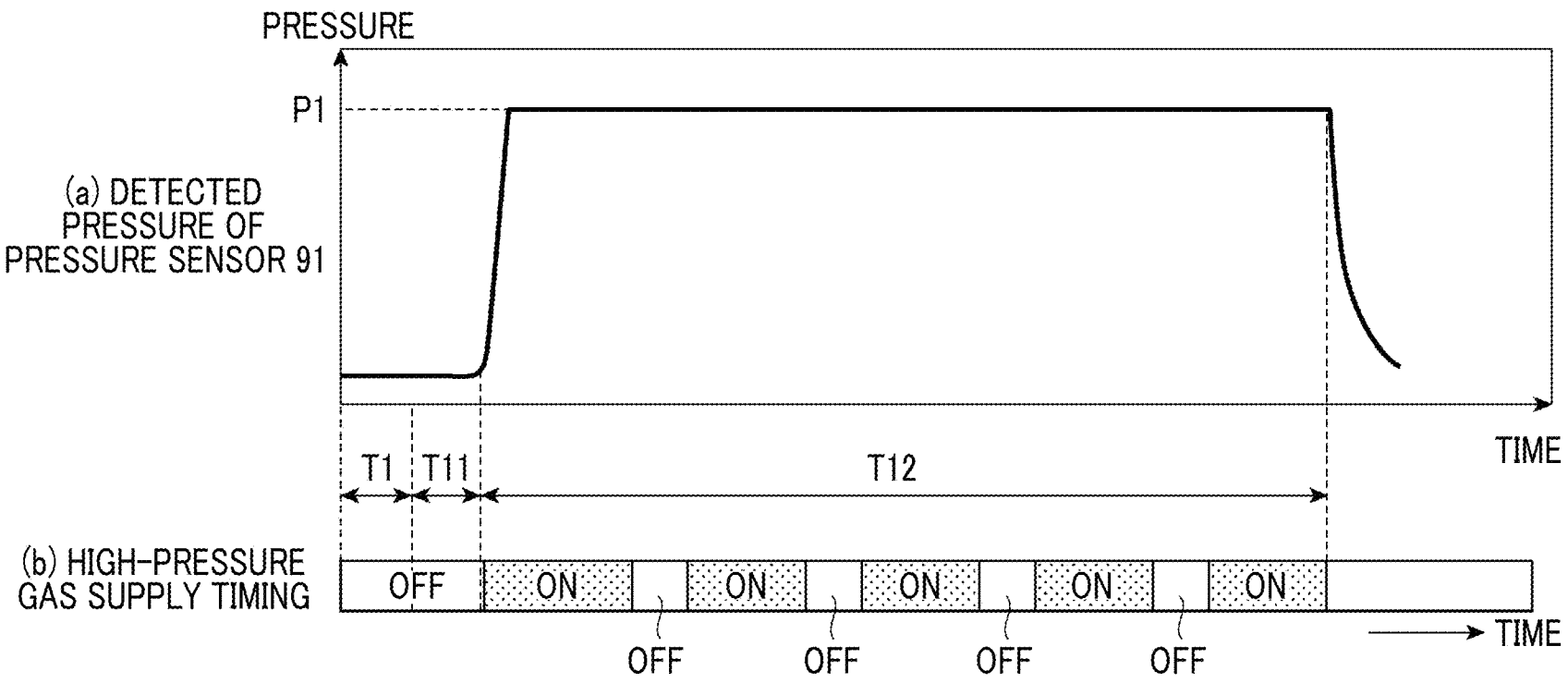
FIG. 10 is a timing chart showing a relationship between a detected pressure of a pressure sensor and gas supply in a blow forming step according to another example.
Figure 11A:
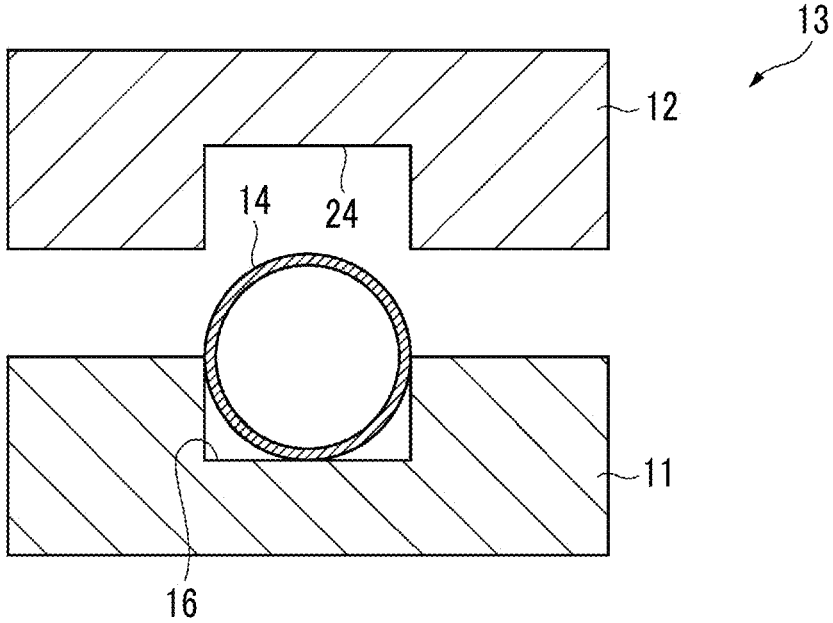
FIGS. 11A to 11C are views showing an operation of the blow forming die according to another example and a change of a shape of a metal pipe material.
Figure 11B:
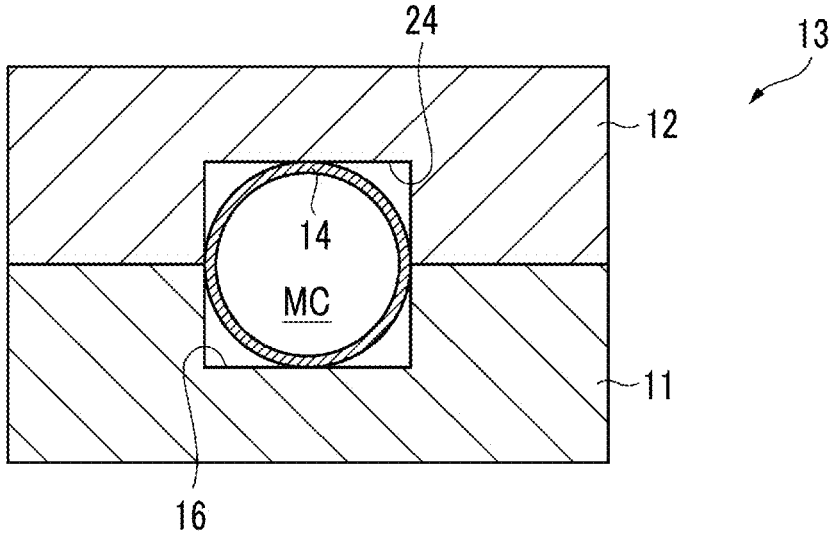
Figure 11C:
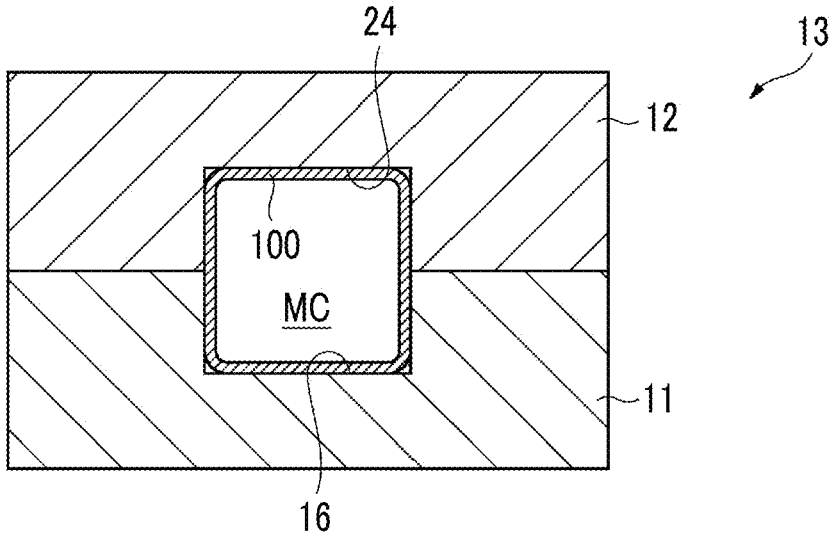

First, as shown in FIGS. 10 and 11A, in the period T1 of FIG. 10, the heated metal pipe material 14 is provided between the cavity 24 of the upper die 12 and the cavity 16 of the lower die 11. For example, the metal pipe material 14 is placed on the cavity 24 of the lower die 11. Next, in a period T11 after the period T1 shown in FIG. 10, the drive mechanism 80 moves the upper die 12 in the direction in which the upper die 12 is to be joined to the lower die 11. Accordingly, as shown in FIG. 11B, the upper die 12 and the lower die 11 come into close contact with each other, and thus, the sealed main cavity portion MC is formed.

Next, during a period T12 after the period T11 shown in FIG. 10, the high-pressure gas is supplied into the metal pipe material 14 by the gas supply unit 60. The high-pressure gas is intermittently supplied to the metal pipe material 14 so as to maintain the pressure in the metal pipe material 14 at the first pressure P1. According to the supply of the high-pressure gas, the metal pipe material 14 in the main cavity portion MC expands, and as shown in FIG. 11C, the metal pipe 100A which does not have the flange portions is formed. In this way, when the metal pipe 100A, the high-pressure gas is intermittently supplied into the metal pipe material 14, and thus, it is possible to prevent the pressure drop in the metal pipe 100A, and it is possible to suppress a decrease in the force for pressing the metal pipe 100A against the upper die 12 and the lower die 11. Accordingly, it is possible to suppress occurrence of variations in hardenability in the metal pipe 100A.

It should be understood that the invention is not limited to the above-described embodiment, but may be modified into various forms on the basis of the spirit of the invention. Additionally, the modifications are included in the scope of the invention. For example, in the embodiments, the forming device 10 does not necessarily have the heating mechanism 50, and the metal pipe material 14 may be heated in advance.

In the above-described embodiments, in the period T3 or the period T5, the gas supply of the gas supply unit 60 may not be intermittently controlled under the control of the controller 70, or may be continuous. In a case where the gas supply of the gas supply unit 60 is continuously performed, it is preferable to control the pressure in the pipe portion 100*a* by the pressure control valve 68 or the like.

In the above-described embodiments, when the portions 14*a* and 14*b* of the metal pipe material 14 are expanded, it is not necessary to maintain the pressure of the low-pressure gas in the metal pipe material 14 at the second pressure P2. For example, in the period T3, similarly to the comparative example, the gas supply of the gas supply unit 60 may be controlled. That is, in the period T3, the controller 70 may control the gas supply of the gas supply unit 60 such that the gas supply is performed until the gas supply reaches a predetermined value.

The gas source 61 according to the above-described embodiments may have both a high-pressure gas source for supplying the high-pressure gas and a low-pressure gas source for supplying the low-pressure gas. In this case, the gas may be supplied from the high-pressure gas source or the low-pressure gas source to the gas supply mechanism 40 according to a situation by controlling the gas source 61 of the gas supply unit 60 by the controller 70. In addition, in a case where the gas source 61 has the high-pressure gas source and the low-pressure gas source, the accumulator 62 (or the gas tanks 111A to 111D) may not be included in the gas supply unit 60.

Although the accumulator 62 according to the above-described embodiments has the four gas tanks 111A to 111D, the number of the gas tanks provided in the accumulator 62 may be three or less, or five or more. In addition, the pressures of the gases stored in the gas tanks 111A to 111D may all be the first pressure P1. In this case, in the period T3, for example, the portions 14*a* and 14*b* of the metal pipe material 14 may be expanded using the low-pressure gas source.

In the drive mechanism 80 according to the above-described embodiments, only the upper die 12 is moved, but in addition to or instead of the upper die 12, the lower die 11 may be moved. In a case where the lower die 11 moves, the lower die 11 is not fixed to the base 15 but is attached to the slide of the drive mechanism 80.

The metal pipe 100 according to the above-described embodiments may have the flange portion on one side thereof. In this case, one sub cavity portion formed by the upper die 12 and the lower die 11 is provided.

In the above-described embodiments, the metal pipe material 14 prepared between the upper die 12 and the lower die 11 may have a cross-sectional elliptical shape in which a diameter in a right-left direction is larger than a diameter in an up-down direction. Accordingly, a portion of the metal pipe material 14 may be made to easily enter the sub-cavity portions SC1 and SC2. In addition, the metal pipe material 14 may be bent (pre-bent) in advance along the axial direction. In this case, the formed metal pipe 100 has the flange portion and is formed in a bent cylindrical shape.

What is claimed is:

1. A forming device for forming a metal pipe, the forming device comprising:

a drive mechanism configured to move a first die towards a second die, when a metal pipe material comprising a pipe portion and a flange portion is between the first die and the second die, in a manner that causes the metal pipe material to come into contact with the first die and the second die;

a gas supply unit configured to supply, into the metal pipe material that is in contact with the first die and the second die, a gas that forms the metal pipe material by expanding the metal pipe material;

a cooling apparatus configured to cool, after the gas expands the metal pipe material, the metal pipe material that is between the first die and the second die; and a controller configured to control, while the cooling apparatus cools the metal pipe material, the gas supply unit in a manner that causes the gas supply unit to maintain the gas at an operating pressure for a period of time, and wherein the gas supply unit is configured to supply the gas to maintain pressure in the metal pipe material at a pressure other than the operating pressure so as to form the flange portion of the metal pipe.

2. The forming device according to claim 1, wherein the controller configured to control, while the gas expands the metal pipe material, the gas supply unit in a manner that causes the gas supply unit to supply the gas at the operating pressure.

3. The forming device according to claim 1, wherein the gas supply unit is configured to cause, by maintaining the gas at the operating pressure, the metal pipe material to remain in contact with the first die and the second die for the period of time.

4. The forming device according to claim 1, wherein the cooling apparatus is configured to cool, after the gas forms the metal pipe material, the metal pipe material by cooling the first die.

5. The forming device according to claim 1, wherein the cooling apparatus is configured to cool, after the gas forms the metal pipe material, the metal pipe material by cooling the second die.

6. The forming device according to claim 1, wherein the cooling apparatus further comprises a cooling medium that is blown onto the metal pipe material to cool the metal pipe material.

7. The forming device according to claim 1, wherein the gas supply unit is configured to supply, into the metal pipe material that is in contact with the first die and the second die, the gas so as to constantly maintain the operating pressure in the metal pipe material at the pressure and prevent pressure drop in the metal pipe material caused by the cooling of the metal pipe material.

8. The forming device according to claim 1, wherein the controller is configured to control the drive mechanism in a manner that causes the drive mechanism to move the first die toward the second die.

9. The forming device according to claim 1, further comprising:

a heating mechanism configured to heat the metal pipe material when the metal pipe material is between the first die and the second die.

10. The forming device according to claim 9, wherein the controller is configured to control the gas supply unit in a manner that causes the gas supply unit to supply, when the metal pipe material is heated by the heating mechanism, the gas into the metal pipe material that is between the first die and the second die.

11. The forming device according to claim 9, wherein the heating mechanism is configured to heat the metal pipe material before the gas supply unit supplies the gas into the metal pipe material that is between the first die and the second die.

12. The forming device according to claim 1, wherein the gas supply unit is configured to supply the gas to maintain pressure in the metal pipe material at the operating pressure so as to form the pipe portion of the metal pipe.

13. The forming device according to claim 1, wherein the first die and the second die constitute:

a first cavity portion for forming the pipe portion, and a second cavity portion for forming the flange portion.

14. The forming device according to claim 13, wherein the second cavity portion communicates with the first cavity portion.

15. The forming device according to claim 13, further comprising:

a heater configured to heat the metal pipe material, wherein the gas supply unit comprises gas storage means for:

storing the gas, and supplying the gas stored in the gas storage means into the metal pipe material so as to maintain the pressure of the gas in the metal pipe material at a first pressure or a second pressure.

16. A forming device for forming a metal pipe, the forming device comprising:

a drive mechanism configured to move a first die towards a second die, when a metal pipe material comprising a pipe portion and a flange portion is between the first die and the second die, in a manner that causes the metal pipe material to come into contact with the first die and the second die;

a gas supply unit configured to supply, into the metal pipe material that is in contact with the first die and the second die, a gas that forms the metal pipe material by expanding the metal pipe material;

a cooling apparatus configured to cool, after the gas expands the metal pipe material, the metal pipe material that is between the first die and the second die;

a controller configured to control, while the cooling apparatus cools the metal pipe material, the gas supply unit in a manner that causes the gas supply unit to maintain the gas at an operating pressure for a period of time; and a heater configured to heat the metal pipe material, wherein the gas supply unit comprises gas storage means for:

storing the gas, and supplying the gas stored in the gas storage means into the metal pipe material so as to maintain the pressure of the gas in the metal pipe material at a first pressure or a second pressure, wherein the first die and the second die constitute:

a first cavity portion for forming the pipe portion, and a second cavity portion for forming the flange portion, wherein the controller is configured to:

control the gas supply of the gas supply unit to expand a portion of the metal pipe material so as to form the flange portion in the second cavity portion, and control the gas supply of the gas supply unit so as to maintain the pressure of the gas in the metal pipe material at the second pressure lower than the first pressure.

17. A forming device for forming a metal pipe, the forming device comprising:

a drive mechanism configured to move a first die towards a second die, when a metal pipe material comprising a pipe portion and a flange portion is between the first die and the second die, in a manner that causes the metal pipe material to come into contact with the first die and the second die;

a gas supply unit configured to supply, into the metal pipe material that is in contact with the first die and the second die, a gas that forms the metal pipe material by expanding the metal pipe material;

a cooling apparatus configured to cool, after the gas expands the metal pipe material, the metal pipe material that is between the first die and the second die; and a controller configured to control, while the cooling apparatus cools the metal pipe material, the gas supply unit in a manner that causes the gas supply unit to maintain the gas at an operating pressure for a period of time, wherein the first die and the second die constitute:

a first cavity portion for forming the pipe portion, and a second cavity portion for forming the flange portion, wherein the gas supply unit is configured to supply, at a pressure lower than the operating pressure, the gas into the metal pipe material so as to expand a portion of the metal pipe material in the second cavity portion in a state where the first die and the second die are not closed.

18. The forming device according to claim 17, wherein a supply time of the gas for maintaining the pressure of the gas in the metal pipe material at the operating pressure is longer than a supply time of the gas for maintaining the pressure of the gas in the metal pipe material at the pressure lower than the operating pressure.

* * * * *